United States Patent [19]

Pitel

[11] 3,931,544

[45] Jan. 6, 1976

[54] FAST WARM UP ELECTRONIC BALLAST CIRCUIT FOR A HIGH PRESSURE DISCHARGE LAMP

[75] Inventor: Ira Jay Pitel, Williamsport, Pa.

[73] Assignee: GTE Sylvania Incorporated, Stamford, Conn.

[22] Filed: Dec. 5, 1974

[21] Appl. No.: 529,818

[52] U.S. Cl. ..... 315/273; 315/208; 315/240; 315/244; 315/283; 315/DIG. 7

[51] Int. Cl.[2] ..... H05B 41/16

[58] Field of Search ..... 315/246, 272, 273, 274, 315/275, 276, 283, 208, 240, 244, DIG. 7

[56] References Cited

UNITED STATES PATENTS

| | | | |
|---|---|---|---|
| 3,471,747 | 10/1969 | Gershen | 315/283 X |
| 3,486,069 | 12/1969 | Mahler | 315/DIG. 7 |
| 3,486,070 | 12/1969 | Engel | 315/DIG. 7 |
| 3,699,385 | 10/1972 | Paget | 315/274 X |
| 3,732,460 | 5/1973 | Wattenbach | 315/DIG. 7 X |

*Primary Examiner*—Palmer C. Demeo
*Attorney, Agent, or Firm*—Norman J. O'Malley; Thomas H. Buffton; Robert T. Orner

[57] ABSTRACT

An electronic ballast circuit for reducing the warm up time of high intensity discharge (HID) lamps wherein lamp current flow is abruptly reduced by a switching means responsive to load voltage variations upon attainment of power in an amount sufficient to activate the HID lamp.

15 Claims, 3 Drawing Figures

FAST WARM UP ELECTRONIC BALLAST CIRCUIT FOR A HIGH PRESSURE DISCHARGE LAMP

BACKGROUND OF THE INVENTION

This invention relates to electronic ballast circuits for high intensity discharge (HID) lamps and more particularly to an electronic ballast circuit for effecting a relatively rapid activation of a HID lamp.

Generally, high intensity discharge (HID) lamps, such as mercury-arc lamps, for example, have a negative resistance impedance where its maintaining voltage is a function of the arc tube's temperature. Ordinarily, a ballast inductor is employed which limits the current flow with respect to lamp voltage. As a result the power available at the lamp is limited and a relatively long warm-up period is required before the desired lighting is attained. Moreover, the ballast inductor type circuitry is relatively inefficient and subject to poor power regulation in the event of line voltage fluctuations.

In an attempt to overcome the above-mentioned disadvantages, electronic ballast circuitry evolved and a lengthy discussion of such circuitry is contained on pages 594–606 of an article entitled "Power Transistors Application Note AN-3616" issued by RCA Solid State Division. Therein, electronic ballast circuits such as a ringing-choke converter, a push-pull inverter, and a switching regulator are discussed in detail.

In the above-mentioned discussion, it is noted that the ringing-choke converter has a relatively poor operating efficiency while the push-pull inverter suffers from relatively poor regulation and requires an excessive amount of magnetic components. Thus, the preferred electronic ballast circuit is the switching regulator type of circuitry.

As to the switching regulator type of ballast circuitry, it has been a common practice to provide circuitry to gradually decrease the current flow through the lamp as the voltage across the lamp increases. As a result, power in an amount sufficient to effect lighting eventually appears at the lamp. However, it has been found that such circuitry does leave something to be desired as to complexity of the circuit as well as an undesired relatively long warm-up period before the desired lighting is achieved.

OBJECTS AND SUMMARY OF THE INVENTION

An object of the present invention is to provide enhanced ballast circuitry for high intensity discharge (HID) lamps. Another object of the invention is to provide relatively simple and inexpensive but improved ballast circuitry for HID lamps. Still another object of the invention is to provide improved ballast circuitry for effecting a reduction in warm-up time of HID lamps.

These, and other objects, advantages and capabilities are achieved in one aspect of the invention by an electronic ballast circuit wherein load current provided by an oscillator means is sampled and utilized to control a first switching means which, in turn, controls the oscillator and a second switching means which is utilized to abruptly alter the flow of current through an HID lamp in accordance with the potential applied thereto whereby the rate of application of power to the lamp is increased causing a desired decrease in warm-up time.

DESCRIPTION OF THE PREFERRED EMBODIMENT

For a better understanding of the present invention, together with other and further objects, advantages and capabilities thereof, reference is made to the following disclosure and appended claims in connection with the accompanying drawings.

Figure 1:
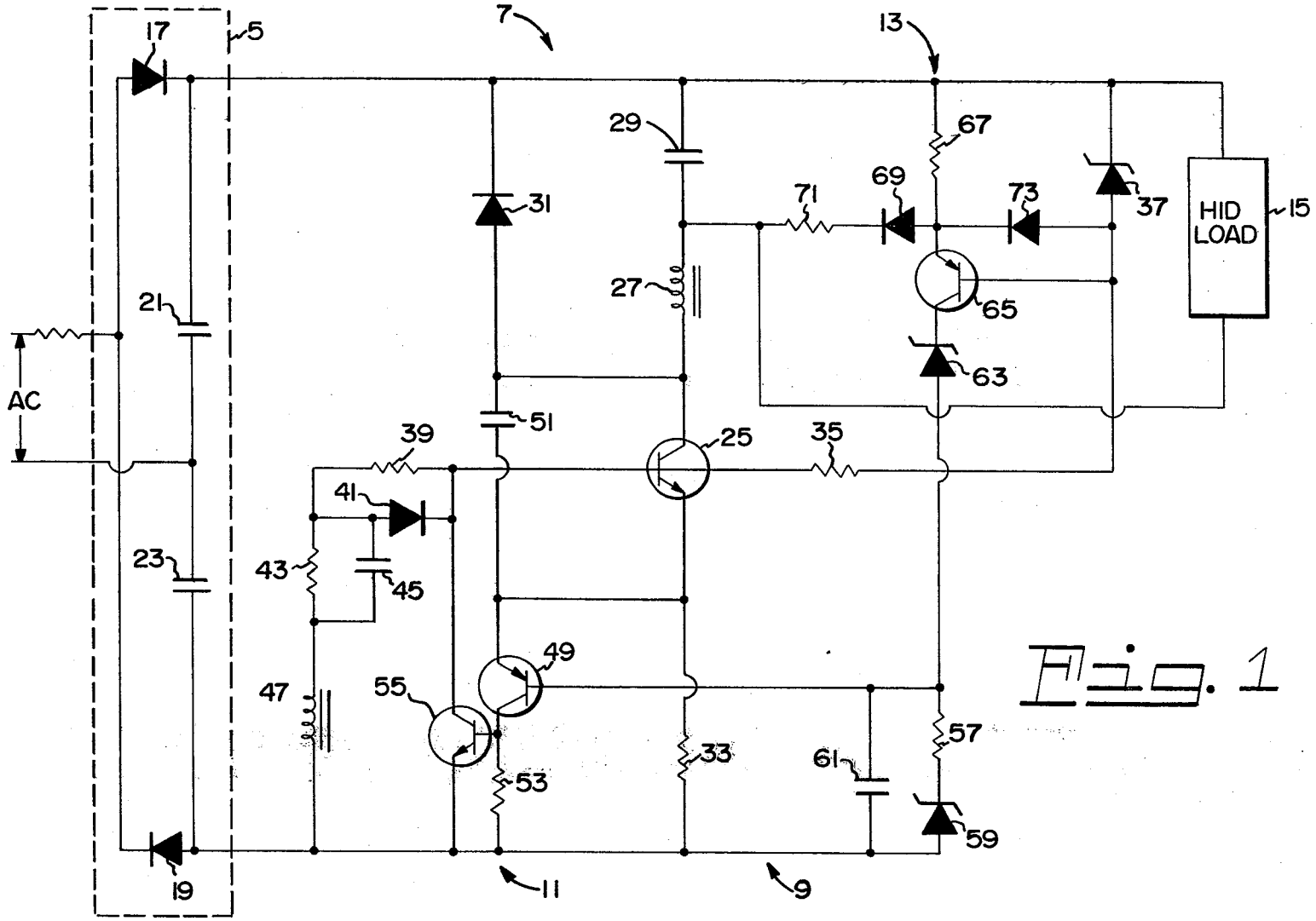
FIG. 1 is a schematic illustration of a preferred embodiment of the invention.

Referring to FIG. 1 of the drawings, an AC potential source is coupled to the oscillator circuit 7. A current sampling means 9 is coupled to the oscillator circuit 7 and to a first switching circuit 11. Also, a second switching means 13 is coupled to the rectifier and voltage doubler means 5, to the oscillator circuit 7, and to the first switching circuit 11. Moreover, a HID lamp circuit 15 is coupled to the oscillator circuit 7 and to the first switching circuit 11.

The rectifier and voltage doubler means 5 includes a pair of oppositely-poled diodes 17 and 19 connected to one input of the AC source. The other input of the AC source is coupled by a capacitor 21 to the one diode 17 and by another capacitor 23 to another diode 19.

The oscillator circuit 7 includes a transistor 25 having a collector coupled to a first inductive winding 27 connected by a charge storage means or capacitor 29 and shunted by a diode 31 to the rectifier and voltage doubler means 5. The emitter of the transistor 25 is connected to ground via the current sampling means 9 in the form of a resistor 33 and to the first switching circuit 11. The base of the transistor 25 is series connected by a resistor 35 and zener diode 37 to the rectifier and voltage doubler means 5. Also, the base of the transistor 25 is connected to circuit ground via a resistor 39 shunted by a diode 41 in series with a resistor 43 shunted by a capacitor 45 and a second inductive winding 47.

The first switching circuit 11 includes a first transistor 49 having an emitter coupled to the emitter of the transistor 25 of the oscillator circuit 7 and via a capacitor 51 to the collector of the transistor 25, the first inductive winding 27, and the diode 31 of the oscillator circuit 7. The collector of the transistor 49 is coupled to circuit ground by a resistor 53 and to the base of a second transistor 55 having a grounded emitter and a collector connected to the base of the transistor 25 of the oscillator circuit 7.

The base of the transistor 49 of the first switching circuit 11 is coupled to a series connected resistor 57 and zener diode 59 shunted by a capacitor 61 and connected to circuit ground. The junction of the resistor 57, capacitor 61, and base of the transistor 49 is coupled by a zener diode 63 to the collector of a transistor 65 of the second switching means 13. The transistor 65 has a base coupled to the junction of the resistor 35 and zener diode 37 and an emitter connected by a resistor 67 to the rectifier and voltage doubler means 5. Also, the emitter of the transistor 65 is connected to a diode 69 coupled by a resistor 71 to the junction of the first inductive winding 27 and the charge storage means 29. Moreover, another diode 73 couples the emitter of the transistor 65 to the junction of the resistor 35 and zener diode 37.

Additionally, the HID lamp circuit 15 has one terminal connected to the rectifier and voltage doubler means 5 and the other terminal connected to the junction of the first inductive winding 27 and the charge capacitor 29. Thus, the HID lamp circuit 15 is essentially shunted across the charge capacitor 29.

As to operation, activation of the system causes application of the AC potential to the rectifier and voltage doubler means 5 wherein the AC potential is rectified by the diodes 17 and 19 and filtered by the capacitors 21 and 23. Thus, a DC potential source appears at the junction of the diode 17 and capacitor 21.

A bias network includes the zener diode 37 connected to the DC potential source and by a resistor 35 to the base of the transistor 25 of the oscillator means 7. Also, the base of the transistor 25 is coupled to circuit ground via the series connected resistor 39, resistor 43, and second inductive winding 47. Thus, the transistor 25 is forward biased whereupon current flow therethrough is increased.

As current flow through the transistor 25 increases, current flow through the first inductive winding 27 increases. In turn, an increased current flow in the first inductive winding 27 effects an increased current flow, due to the magnetic coupling, in the second inductive winding 47. Thereupon a saturation condition is effected for the transistor 25 and a charge is built up on the charge capacitor 29.

Further, increased current flow through the transistor 25 causes development of an increased potential across the resistor 33. When the voltage as the resistor 33 exceeds the voltage available at the capacitor 61, transistor 49 becomes forward biased and conductive. The conduction of the transistor 49 causes development of an increased potential at the resistor 53 which forward biases the transistor 55.

Conduction of the transistor 55 reduces the current flow to the base of the transistor 25 due to the current path which includes the second inductive winding 47, the resistor 43, the capacitor 45, the resistor 39, the diode 41, and the transistor 55. Thus, conductivity of the transistor 55 causes a limiting of current flow through the transistor 25.

Since current flow through the transistor 25 has been limited, current stored in the first inductive winding 27 flows through the diode 31 to effect maintainance of a charge on the capacitor 29. Moreover, the voltage developed across the second inductive winding 47, due to the magnetic coupling, is reversed whereupon the transistor 25 of the oscillator means 7 is rendered non-conductive or cut off. As the current flow through the inductive winding 27 reaches zero, the transistor is again forward biased by way of the bias network including the zener diode 37, the resistor 35, the resistor 39, resistor 43, and second inductive winding 47. Thus, the cycle is repeated and the transistor 25 again becomes conductive.

As to the fast warm-up capabilities of the circuitry, the transistor 65 of the second switching means 13 is biased on by the zener diode 37 and resistor 67 so long as the voltage across the lamp circuit 15 is relatively low, below 100$^v$ for example.

As long as this load voltage remains relatively low, current flows through the transistor 65 and resistor 57 causing an increase in the potential appearing at the junction of the capacitor 61 and resistor 57. Therefore, a higher voltage is required across the resistor 33 whereupon the peak current flow through the transistor 25 and lamp circuit 15 remains relatively high.

When the voltage applied to the lamp circuit 15 and available across the charge capacitor 29 reaches a given value, such as 100$^v$ for example, the diode 69 is rendered conductive. Thereupon, the base to emitter voltage of the transistor 65 is reduced turning the transistor 65 off or non-conductive and current flow therethrough decreases rapidly. Once the current flow through the transistor 65 and resistor 57 has decreased, the potential at the capacitor 61 decreases whereupon the threshold of conductivity of the transistors 49 and 55 is reduced causing a reduction in the peaks of the current flowing through the transistor 25. Therefore, a reduction in the peak currents flowing through the transistor 25 causes an abrupt reduction in current flow to the lamp circuit 15.

In summary, the current flow through the lamp circuit 15 is maintained at a relatively high value with the transistor 65 of the second switching means 13 in a conductive state as the potential of lamp circuit 15 gradually increases. When the potential of lamp circuit 15 and the transistor 65 reaches a given value, 100-volts for example, the transistor 65 is rendered non-conductive and current flow to the lamp circuit 15 abruptly decreases. However, the combined relatively high current flow and potential of lamp circuit 15 provide power in an amount sufficient to reduce the time period required to effect activation of the lamp circuit 15.

Figure 2:
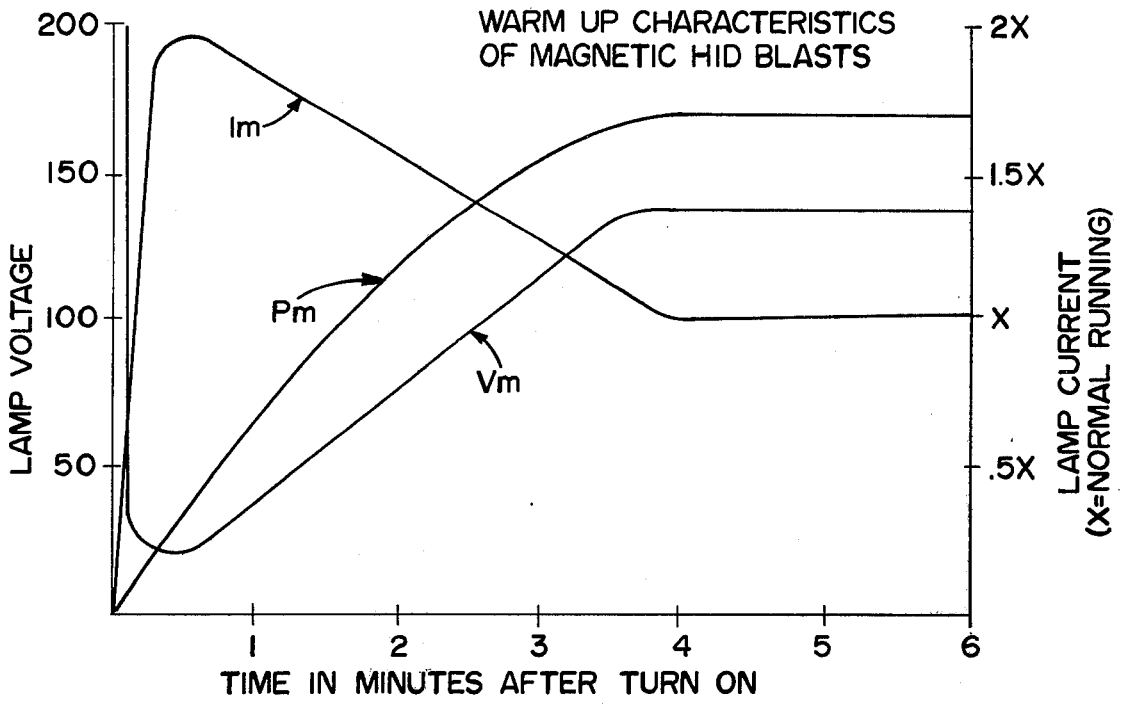
FIG. 2 is a graphic illustration of the warm-up characteristics of a prior art form of electronic ballast.
Figure 3:
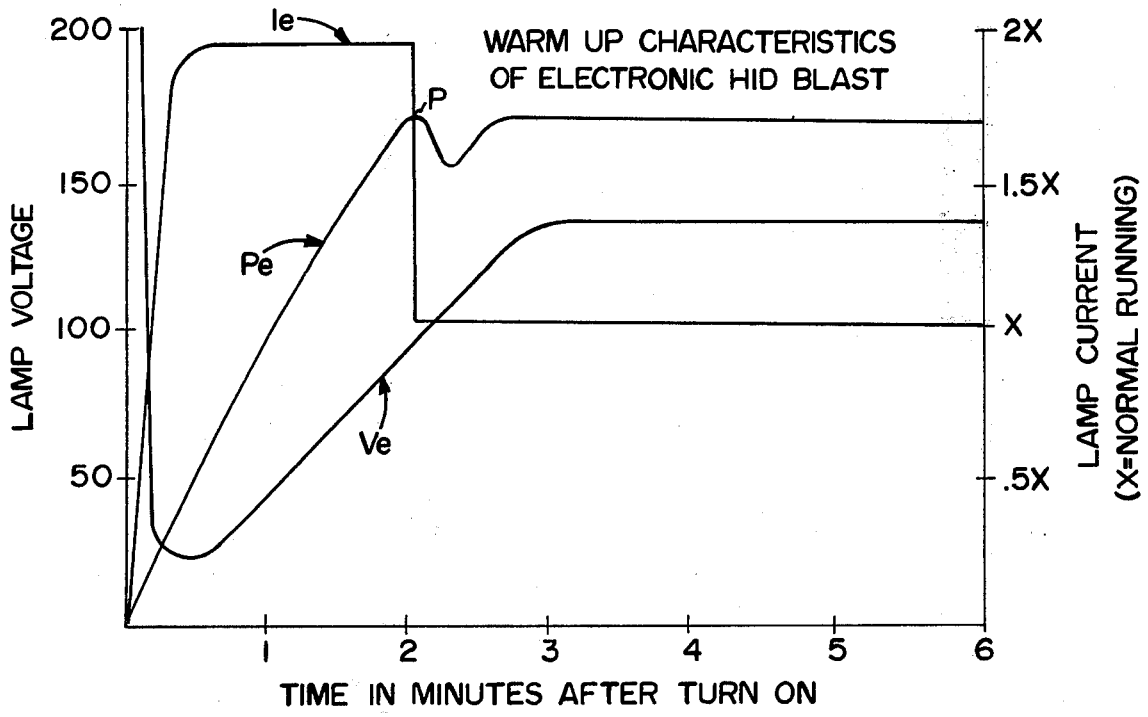
FIG. 3 is a graphic illustration of the warm-up characteristics of the embodiment of FIG. 1.

In order to clarify the above explanation, reference is made to FIGS. 2 and 3 of the drawings. FIG. 2 is a graphic illustration of the warm-up characteristics of a prior art form of ballast circuit for HID lamps. As can be seen, the voltage Vm of a lamp circuit in a magnetic ballast circuit is of a relatively high value, 200-volts for example, initially until the gas in the HID lamp ionizes whereupon the voltage Vm decreases rapidly to a relatively low value and then gradually increases until a steady-state condition is reached. Also, the current Im applied to the lamp circuit rapidly increases to a relatively high value and gradually decreases to a steady-state condition. Moreover, the power applied to the lamp circuit, as illustrated by the curve marked Pm, is a product of the above-mentioned voltage Vm and current Im and gradually increases to a steady-state condition in an amount sufficient to effect energization of the lamp circuit.

As can be seen in the graphic illustration of FIG. 3, a ballast circuit such as described for effecting a fast warm-up period, provides a current Ie to the lamp circuit 15 which increases rapidly to a relatively high value and is maintained thereat for a period of time. The voltage Ve of the lamp circuit 15 has a relatively high initial value, decreases rapidly to a relatively low value, and gradually increases.

After a given period of time, the voltage Ve of the second switching means 13 is of an amount such that transistor 65 therein switches from a conductive to a non-conductive state whereupon the current Ie applaied to the lamp circuit 15 is abruptly reduced. However, the power Pe applied to the lamp circuit 15 reaches a value sufficient to activate the lamp circuit 15 in a period which is relatively short as can be seen on the graphic illustration of FIG. 3.

Thus, there has been provided a unique fast warm-up ballast circuit for a HID lamp circuit. The ballast circuit is simple and inexpensive of components while greatly reducing the period required to activate a lamp circuit by known apparatus.

While there has been shown and described what is at present considered a preferred embodiment of the invention, it will be obvious to those skilled in the art that various changes and modifications may be made therein without departing from the invention as defined by the appended claims.

What is claimed is:

1. A ballast circuit for a high pressure arc lamp comprising:

a potential source;

oscillator means coupled to said potential source;

current sampling means coupled to said oscillator means;

first switching means coupled to said current sampling means and to said oscillator means;

load circuit means coupled to said potential source and to said oscillator means; and second switching means coupled to said potential source and load circuit means and to said first switching means, said second switching means effecting an abrupt shift in current flow through said load circuit means in accordance with attainment of a threshold level of voltage of said load circuit means.

2. The ballast circuit of claim 1 wherein said potential source includes a voltage rectifier means coupled to an AC voltage source.

3. The ballast circuit of claim 1 wherein said oscillator means includes an electron discharge device having an output electrode coupled by a first inductive winding and a charge storage means shunted by a uni-directional conduction device to said potential source.

4. The ballast circuit of claim 1 wherein said oscillator means includes an electron device having an electrode coupled to said first switching means and via said current sampling means to a potential reference level.

5. The ballast circuit of claim 1 wherein said first switching means includes a second inductive winding magnetically coupled to said first inductive winding and electrically coupled to said oscillator means.

6. The ballast circuit of claim 1 wherein said oscillator means includes a first inductive winding coupled to a charge storage means shunted by said load circuit means.

7. The ballast circuit of claim 1 wherein said second switching means includes an electron device having one electrode coupled to said oscillator means and to a charge storage means and another electrode coupled to an impedance and to said first switching means whereby attainment of a given threshold potential on said charge storage means renders said electron device non-conductive and an abrupt reduction in current flow through said load circuit means.

8. The ballast circuit of claim 1 wherein said oscillator means includes a first inductive winding, said first switching means includes a second inductive winding with said first and second inductive windings magnetically coupled to provide a positive feedback circuit for said oscillator means.

9. The ballast circuit of claim 1 wherein said second switching means includes an electron device coupled by a unidirectional conduction device to said oscillator means whereby development of a potential above a given threshold level at said oscillator means effects conductivity of said uni-directional conduction device and electron device to abruptly reduce current flow through said load circuit means.

10. A fast warm-up electronic ballast circuit for a high intensity discharge (HID) lamp comprising:

an AC potential source;

rectifier and voltage doubler means coupled to said AC potential source and providing a DC potential source;

oscillator means having a first inductive winding coupled to said rectifier and voltage doubler means;

current sampling means coupling said oscillator means to a potential reference level;

load circuit means coupled to said rectifier and voltage doubler means and to said oscillator means;

first switching means coupled to said oscillator and current sampling means; and second switching means coupled to said oscillator and rectifier and voltage doubler means and to said first switching means whereby a potential available at said oscillator means above a given threshold level alters said second switching means to cause an abrupt reduction in current flow through said load circuit means.

11. The fast warm-up electronic ballast circuit of claim 10 including a charge storage means shunted by said load circuit means and coupling said first inductive winding of said oscillator means to said DC potential source of said rectifier and voltage doubler means.

12. The fast warm-up electronic ballast circuit of claim 10 wherein said second switching means includes an electron device having one electrode coupled via a uni-directional conduction device to said first inductive winding of said oscillator means and to a charge storage means, a second electrode coupled by a second uni-directional conduction device to said one electrode, and a third electrode coupled to an impedance and to said first switching means whereby application of a potential above a given threshold value to said second switching means alters conductivity thereof which effects abrupt alteration of current flow through said load circuit means.

13. The fast warm-up electronic ballast circuit of claim 10 wherein said current sampling means and first and second switching means form a negative feedback circuit for said oscillator means.

14. The fast warm-up electronic ballast circuit of claim 10 wherein said oscillator means includes a first inductive winding coupled to an electron device and via a charge storage means to said rectifier and voltage doubler means and said first switching means includes a second inductive winding magnetically coupled to said first inductive winding whereby a positive feedback circuit is provided.

15. The fast warm-up electronic ballast circuit of claim 10 wherein said second switching means includes an electron device having an output electrode coupled to an impedance shunted by a capacitor and to said first switching means whereby a change in current flow through said second switching means effects change in current flow through said oscillator means and an abrupt change in current flow through said load circuit means.

* * * * *